US006652317B2

(12) United States Patent
Shao

(10) Patent No.: US 6,652,317 B2
(45) Date of Patent: Nov. 25, 2003

(54) ELECTRICAL CONNECTOR

(75) Inventor: Stanly Shao, Chungho (TW)

(73) Assignee: Advanced Connectek Inc., Taipei Hsien (TW)

( * ) Notice: Subject to any disclaimer, the term of this patent is extended or adjusted under 35 U.S.C. 154(b) by 6 days.

(21) Appl. No.: 09/905,949

(22) Filed: Jul. 17, 2001

(65) Prior Publication Data

US 2003/0017744 A1 Jan. 23, 2003

(51) Int. Cl.[7] ..... H01R 13/648
(52) U.S. Cl. ..... 439/607; 439/79
(58) Field of Search ..... 439/607–610, 439/79, 567, 939

(56) References Cited

U.S. PATENT DOCUMENTS 6,241,556 B1 * 6/2001 Chih ..... 439/607
6,364,706 B1 * 4/2002 Ando et al. ..... 439/607

* cited by examiner

*Primary Examiner*—Khiem Nguyen
(74) *Attorney, Agent, or Firm*—Rosenberg, Klein & Lee

(57) ABSTRACT

An electrical connector comprises a shell, an insulative housing and a plurality of terminals. The shell encloses the insulative housing and the terminals are inserted into a plurality of grooves of the insulative housing. The shell has a tongue and two baffling portions; and the insulative housing has corresponding cutouts to form a clamping structure. The shell has a plurality mounting leg each with an elongated bump on an outer surface to adapt the connector to circuit board of various thicknesses. Each of the terminals has at least one shoulder to enhance the structural strength thereof.

7 Claims, 5 Drawing Sheets

ELECTRICAL CONNECTOR

BACKGROUND OF THE INVENTION

1. Field of the Invention

The present invention relates to an electrical connector, in particular, to an electrical connector used for an identification key adapted to PCs. According to the present invention, a shell and a housing of the electrical connector can be assembled in a resistance-free manner. Meanwhile, plural conductive terminals are firmly positioned in the housing, and the connector can be strongly mounted on a circuit board.

2. The Prior Art

In a conventional electrical connector, the insulative housing thereof is assembled to a shell by a locking structure. For example, the shell has a locking hole and the insulative housing has a corresponding bump embedded to the locking hole. However, the locking hole and the bump are tended to loosely engage and gap is formed therebetween due to manufacturing tolerance. Moreover, the locking hole is further widened to receive the bump during embedding operation. The locking structure is not secure, thus causing unwanted loose engagement. To assemble the conventional electrical connector to a circuit board, the circuit board is provided with embedding holes embedded with corresponding embedding plates on the electrical connector. The embedding plate has a panel and projecting portion arranged on the panel and abutting bottom side of the embedding holes, thus locking the electrical connector to the circuit board. The projecting portion can be formed by bending the panel, or by providing elastic plate or ring on the panel. The configuration of the projecting portion should be matched with the thickness of the circuit board. As a result, the applicable range of the electrical connector is limited. The conductive terminal of the electrical connector generally has interfering portion with barb. The interfering portion interferes with the corresponding passageway of the insulative housing to clamp the terminal therein. However, the terminal may be damaged by the barb when the electrical connector is made in miniature fashion.

SUMMARY OF THE INVENTION

It is an object of the present invention to provide an electrical connector wherein a shell and a housing are assembled in a resistance-free manner. Meanwhile, plural conductive terminals are firmly positioned in the housing, and the connector can be strongly mounted on a circuit board, whereby the electrical connector can be used for a miniature component such as identification key.

In one aspect of the invention, the shell has a clamping structure composed of a plurality of baffling portions and at least one tongue. The insulative housing does not require projection structure to assemble with the shell. There is no projecting part present after the shell and the insulative housing are assembled. The tongue is bent to embed into a cutout on the insulative housing, there is no gap therebetween.

In another aspect of the invention, the mounting plate of the shell has a plurality of elongated bump on outer surface thereof such that the connector can be compatible with circuit board of various thicknesses.

In still another aspect of the invention, the insulative housing has a plurality of grooves of tapered shape and each of the terminals has a contact end, an interfering portion and an insertion end with wider shoulders on both sides thereof. The shoulders can protect the terminal when the terminal is inserted into the tapered groove.

The various objects and advantages of the present invention will be more readily understood from the following detailed description when read in conjunction with the appended drawing.

DETAILED DESCRIPTION OF THE PREFERRED EMBODIMENTS

Figure 1:
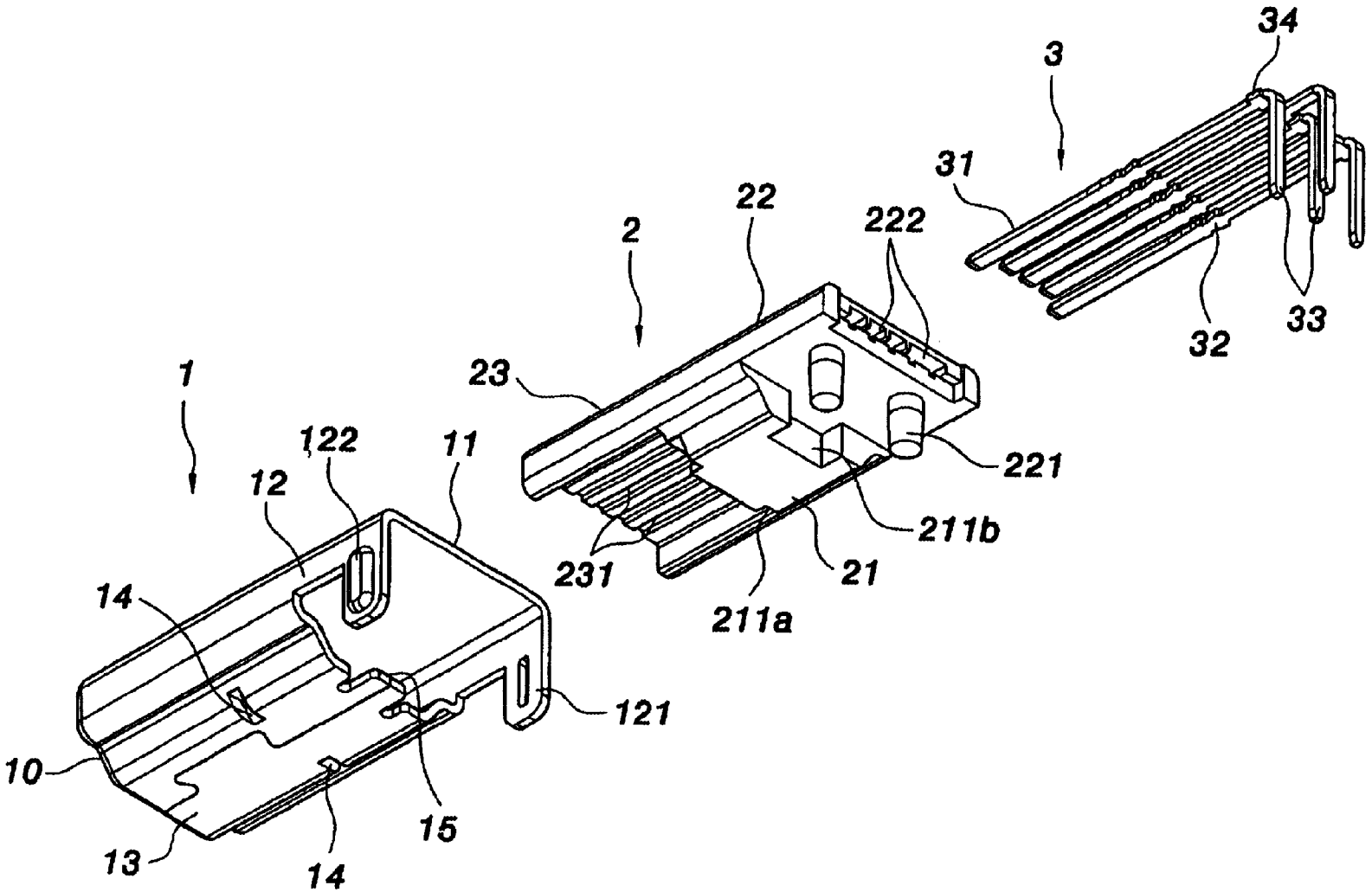
FIG. 1 an exploded view showing the first preferred embodiment of the present invention.
Figure 2:
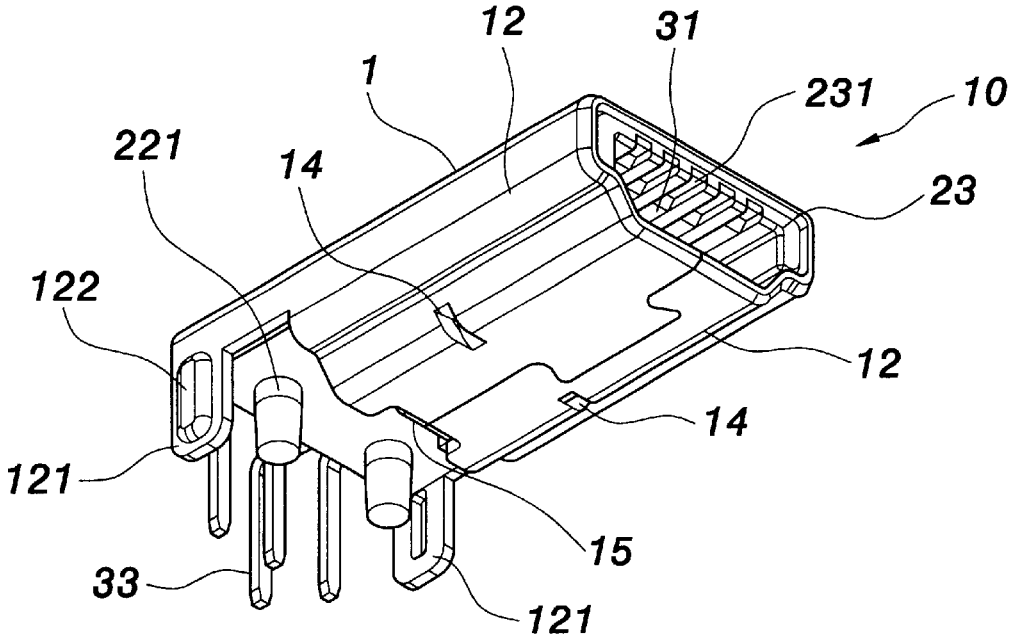
FIG. 2 is a perspective view showing the first preferred embodiment of the present invention.

With reference to FIGS. 1 and 2, an electrical connector in accordance of the first preferred embodiment of the present invention comprises a shell 1, an insulative housing 2, and a plurality of conductive terminals 3. The shell 1 substantially comprises a top surface 11, two asymmetric lateral surfaces 12, and a bottom surface 13. A mating face 10 is formed at a front end of the shell 1. Each lateral surface 12 has a mounting leg 121 provided on an end thereof. The bottom surface 13 of shell 1 further has a pair of baffling portions 14 provided at predetermined locations thereof, and a tongue 15 provided at a rear end thereof to form clamping means with the baffling portions 14.

The insulative housing 2 is formed a positioning block 21 for engaging with the above clamping means of the shell 1. The positioning block 21 has a pair of first cutouts 211*a* provided at front end thereof, corresponding to the two baffling portions 14, and a second cutouts 211*b* centrally provided at a rear end thereof, corresponding to the tongue 15. The insulative housing 2 has a positioning end 22 behind the positioning block 21, which is provided with a plurality of posts 221. The insulative housing 2 also has a guiding end 23 at a front side thereof, which is provided with a plurality of grooves 231 extending from the guiding end 23 to the positioning end 22, thus forming a plurality of passageways 222 for the terminals 3. Each of the terminal 3 comprises a contact end 31 at front side thereof, an insertion end 33 at rear side thereof and an interfering portion 32 bridging the contact end 31 and the insertion end 33. The terminal 3 further comprises a pair of shoulders 34 provided on both sides of the connection between the insertion end 33 and the interfering portion 32 to facilitate the clamping of the terminals 3 in the passageways 222.

The insulative housing 2 can be easily inserted into the shell 1 because the insulative housing 2 does not use projecting parts as locking structure. Moreover, by fitting the two baffling portions 14 to the two cutouts 211 at front end of the clamping bump 21, the insulative housing 2 is located to a clamping position within the shell 1 and then the tongue 15 is bent to embed into the cutout 211 at the rear end of the positioning block 21. Therefore, the baffling portions 14 and the tongue 15 are embedded to respective cutouts 211 and the insulative housing 2 is firmly retained within the shell 1. Moreover, the present invention provides stable assembling and signal transmission for the terminals 3 in the passageways 222 of the guiding end 23 of the insulative housing 2. FIG. 2 is a perspective view showing the first preferred embodiment of the present invention. The connector of the present invention has subtle and secure structure; and thus is suitable for miniature application.

Figure 3:
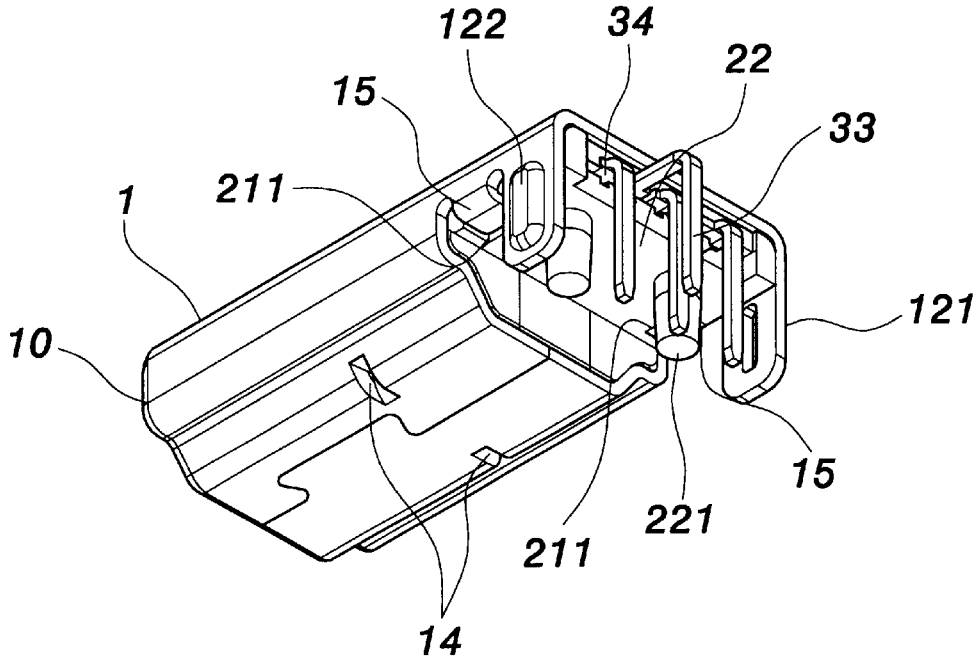
FIG. 3 is a perspective view showing the second preferred embodiment of the present invention.
Figure 4:
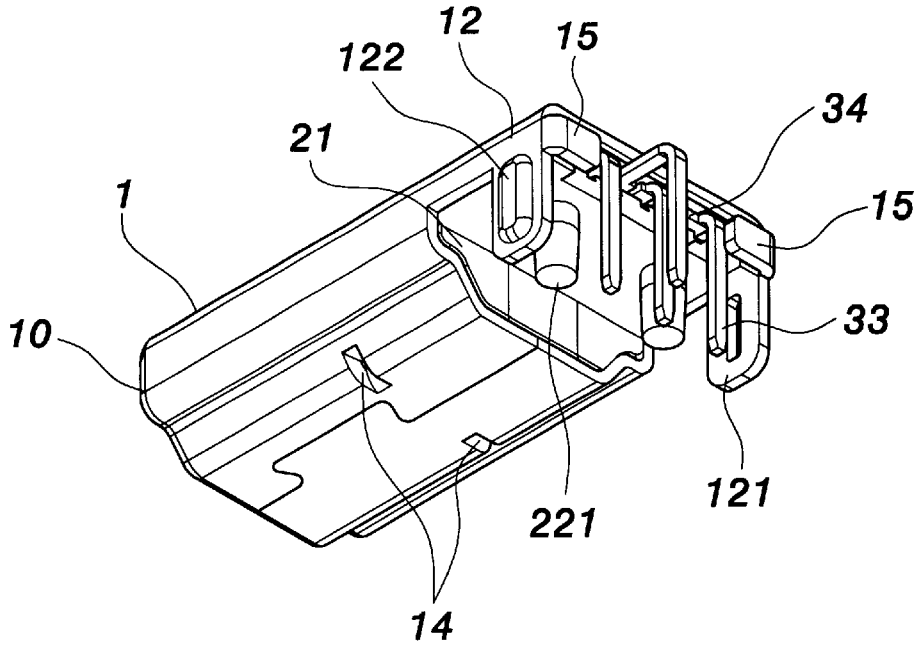
FIG. 4 is a perspective view showing the third preferred embodiment of the present invention.
Figure 5:
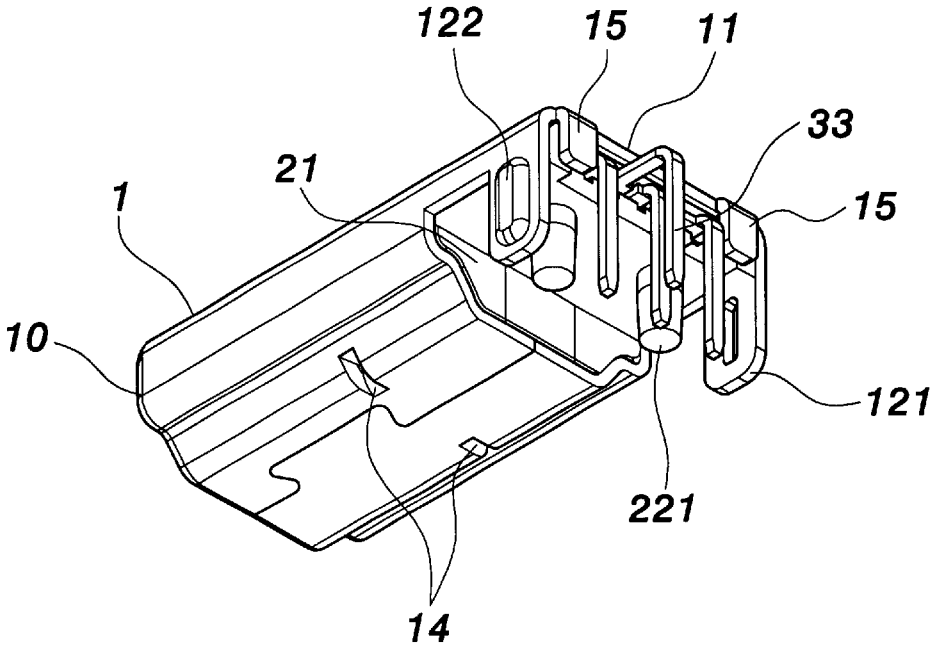
FIG. 5 is a perspective view showing the fourth preferred embodiment of the present invention.

Moreover, for the clamping structure composed of the baffling portions 14, the tongue 15 and the cutouts 211 the tongue 15 also can be provided at a rear part of the shell and the cutouts 211 are arranged at the positioning end 22 of the insulative housing 2. FIG. 3 shows the perspective view of the second preferred embodiment of the present invention. As shown in this figure, two tongues 15 are provided at rear part of the shell 1 and in front the mounting leg 121 located on bottom of the lateral surfaces 12. The two cutouts 211 are provided on the positioning end 22, corresponding to the tongues 15 at rear part of the shell 1. The tongues 15 and the baffling portions 14 are embedded with corresponding cutouts 211 to firmly retain the insulative housing 2 in the shell 1. FIGS. 4 and 5 show the perspective views of the third and fourth embodiments of the present invention. The two tongues 15 are arranged behind the mounting legs 121 and extend respectively from two ends of the two lateral surfaces 12, as shown in FIG. 4, alternatively, extend from two rear ends of the top surface 11. In those arrangements, the tongues 15 are also deformed to provide retaining force and used with the baffling portions 14. The insulative housing 2 is also firmly retained within the shell 1.

Figure 6:
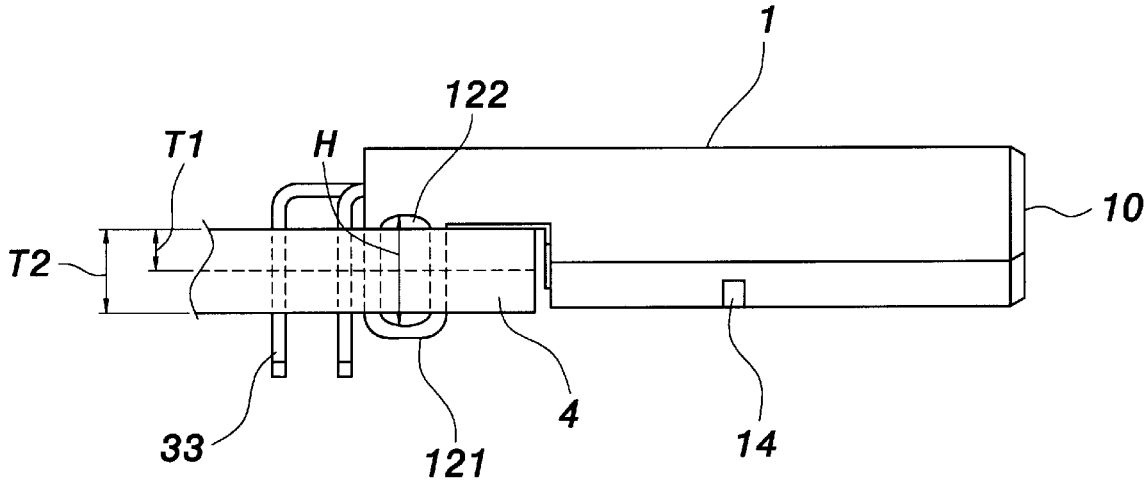
FIG. 6 schematically shows the electrical connector of FIG. 1 is mounted on a printed circuit board.
Figure 7:
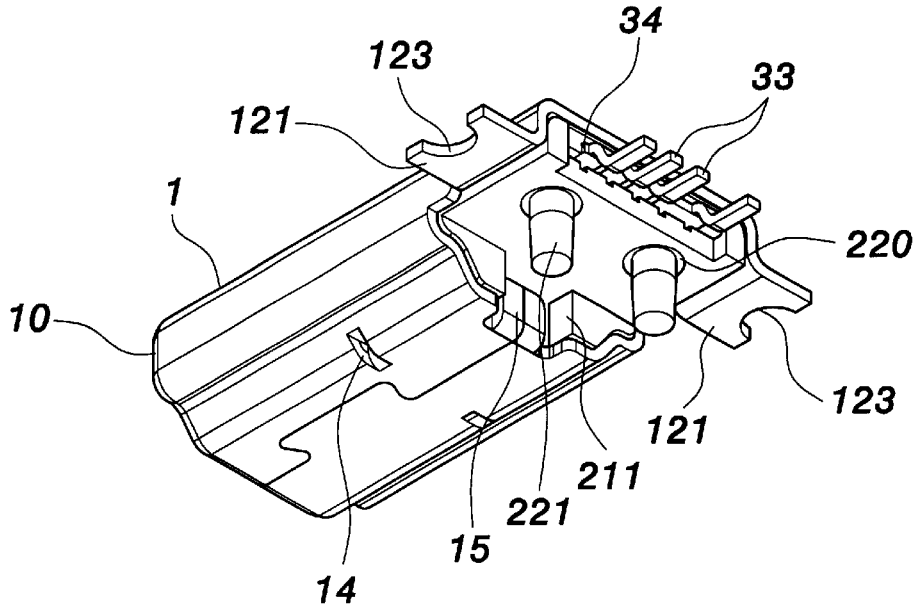
FIG. 7 is a perspective view showing the fifth preferred embodiment of the present invention.

Moreover, each of the mounting legs 121 has an elongated bump 122 on an outer side thereof. The elongated bump 122 has a predetermined height and an arc-shaped circumference. The arc-shaped circumference of the elongated bump 122 renders flexible application for the mounting leg 121 and facilitates the insertion of the electrical connector. As shown in FIG. 6, the elongated bump 122 of predetermined height H can be matched with the circuit board with various thicknesses T1 and T2. If the electrical connector is to be arranged on the circuit board 4 by SMT (surface mount technology), the mounting leg 121 is bent to a horizontal direction and is provided with at least one notch 123 to increase binding area, as shown in FIG. 7. The insertion end 33 of the terminal 3 is bent to the horizontal direction. Each of the posts 221 is of conic shape and has an annular recess 220 around the root thereof, whereby the connector has uniform flatness after assembling to facilitate minimization.

Figure 8:
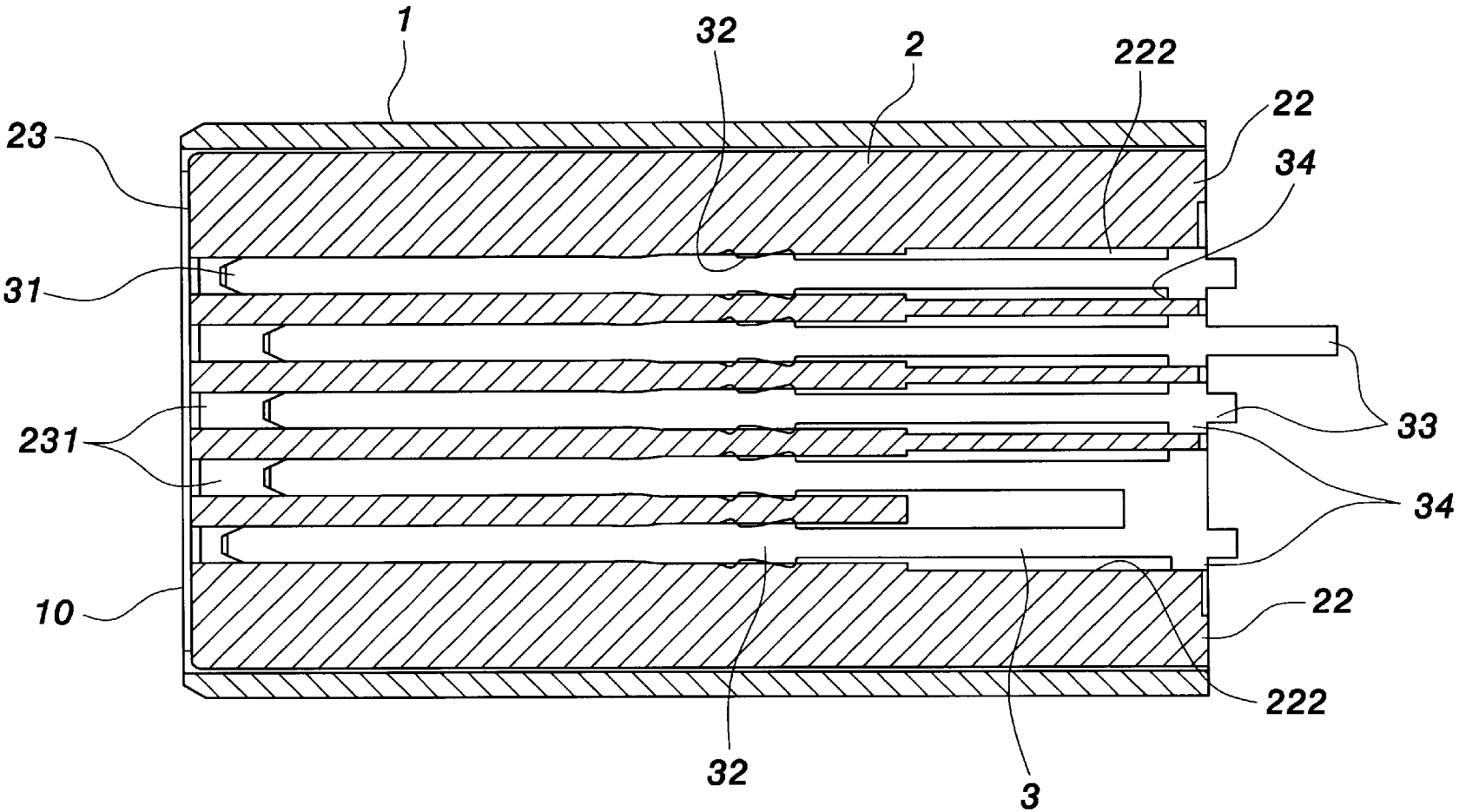
FIG. 8 schematically shows terminals positioned in a housing in accordance with the present invention.

As shown in FIG. 8, each of the grooves 231 is of tapered shape with a narrower end facing the guiding end 23 to facilitate the assembling the interfering portions 32 and the shoulders 34 located behind the contact ends 31. Each of the interfering portions 32 is of conoid tooth shape to distribute the insertion resistance force to the shoulder portions 34 when the terminals 3 are inserted. Therefore, the resistance force exerted to the terminals 3 is reduced. Moreover, each of the terminals 3 is inserted from a wider end of the tapered groove 231; the provision of the conoid tooth by the interference end 32 and the tapered groove 231 can reduce the insertion resistance force. The damage problem caused by the barb of conventional terminal can be prevented to facilitate minimization. Moreover, when the terminals 3 are respectively inserted into the tapered grooves 231, the shoulders 34 are also respectively inserted into the passageways 222 to protect the terminal 3.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An electrical connector comprising a shell, an insulative housing and a plurality of conductive terminals;

said shell having a rear side and a mating face at a front side thereof, said shell having a cavity formed between a top wall, two lateral walls connected respectively to said top wall and a bottom wall connected to said lateral walls, each of the lateral walls having a downward mounting leg extending from a bottom portion thereof, said shell further having a clamping structure including two baffling portions extending into said cavity and at least one tongue extending from a wall of said shell in a plane therewith;

said insulative housing being received in said cavity of said shell from said rear side thereof, said insulative housing having a positioning block on a bottom portion thereof with a pair of first cutouts formed in a front end of said positioning block and being in respective contiguous contact with said baffling portions to block displacement of said insulative housing toward said mating face, said insulative housing having at least one second cutout disposed in correspondence with said at least one tongue, said tongue being bent to be disposed in said second cutout subsequent to said insulative housing being received in said cavity of said shell to block displacement of said insulative housing toward said rear side of said shell, said insulative housing having a plurality of posts on a rear portion thereof and a plurality of grooves on a front side thereof and extending to said rear portion to form a plurality of passageways, each of said grooves being of tapered shape with a narrower end facing the front side of said insulative housing; and, a plurality of terminals respectively disposed in said plurality of passageways.

2. The electrical connector as claimed in claim 1, wherein said shell has one tongue arranged in front of said mounting legs and one of said cutouts is provided at a rear side of said insulative housing in correspondence to said tongue; said tongue is embedded into said cutout to assemble said insulative housing and said shell.

3. The electrical connector as claimed in claim 1, wherein said shell has two tongues, and said two tongues are arranged behind said mounting plates and extend respectively from said two lateral surfaces.

4. The electrical connector as claimed in claim 1, wherein said shell has two tongues, and said two tongues are arranged behind said mounting plate and extended from two ends of said top surface.

5. The electrical connector as claimed in claim 1, wherein each of said mounting legs has an elongated bump on an outer surface hereof, each of said elongated bumps has predetermined height and an arc-shaped circumference.

6. The electrical connector as claimed in claim 1, wherein each of said mounting legs is bent to a horizontal direction and has at least one notch thereon, each of said terminals has an insertion end at a rear end thereof and said insertion end is also bent to said horizontal direction, each of said posts has an annular recess around a root portion thereof.

7. The electrical connector as claimed in any one of claims 1 to 6, wherein each of said terminals has a contact end, an insertion end and an interfering portion bridging said contact end and said insertion end, each of said terminals has at least one shoulder in front of said insertion end; said interfering portion having a specific length and being of conoid tooth shape.

* * * * *